United States Patent [19]

Kondo

[11] 4,209,674

[45] Jun. 24, 1980

[54] PIANO SWITCH

[75] Inventor: Shiro Kondo, Furukawa, Japan

[73] Assignee: Alps Electric Co., Ltd., Tokyo, Japan

[21] Appl. No.: 809,984

[22] Filed: Jun. 27, 1977

[30] Foreign Application Priority Data

Jul. 2, 1976 [JP] Japan ..... 51-87828[U]

[51] Int. Cl.[2] ..... H01H 15/16

[52] U.S. Cl. ..... 200/16 R; 84/343; 200/16 F; 200/339

[58] Field of Search ..... 84/423, 433, 442, 343, 84/344; 200/339, 67 C, 67 A, 67 PK, 76, 16 C, 16 D, 1 A, 5 E, 5 R, 17 R, 18, 153 H, 16 R, 16 F

[56] References Cited

U.S. PATENT DOCUMENTS

| | | | |
|---|---|---|---|
| 2,821,582 | 1/1958 | Kimball | 200/339 X |
| 3,136,869 | 6/1964 | Haviland | 84/343 X |
| 3,217,112 | 11/1965 | Campbell | 200/16 C |
| 3,319,016 | 5/1967 | Hoy et al. | 200/16 C |
| 3,564,172 | 2/1971 | Laasko | 200/67 C |
| 3,668,353 | 6/1972 | Raab | 200/16 C X |
| 3,922,510 | 11/1975 | Arthur | 200/16 D X |
| 3,983,349 | 9/1976 | Denny | 200/339 |
| 4,013,855 | 3/1977 | Reichen et al. | 200/16 D X |

FOREIGN PATENT DOCUMENTS

| | | | |
|---|---|---|---|
| 1202470 | 1/1960 | France | 200/5 E |

*Primary Examiner*—James R. Scott

*Attorney, Agent, or Firm*—Guy W. Shoup; Gerard F. Dunne

[57] ABSTRACT

Disclosed is a piano switch having a driving lever which can be operated without clattering. The driving lever is generally L-shaped and has one end engaging a recess formed in a sliding body. The lever is pivoted to an attaching arm for free rotation. A spring is stretched between a frame of the switch and the driving lever.

1 Claim, 3 Drawing Figures

PIANO SWITCH

BACKGROUND OF THE INVENTION

The present invention relates to piano type switches.

The object of the present invention is to provide an improved piano switch having a driving lever which can be operated with a comfortable feel avoiding unfavourable clattering.

This and other objects, as well as advantageous features of the present invention, will become clear from the following description of a preferred embodiment taken in conjunction with the attached drawings in which:

BRIEF DESCRIPTION OF THE DRAWINGS

FIG. 1 is an exploded perspective view of two piano switches each in accordance with the present invention, while

DESCRIPTION OF THE PREFERRED EMBODIMENTS

Figure 1:
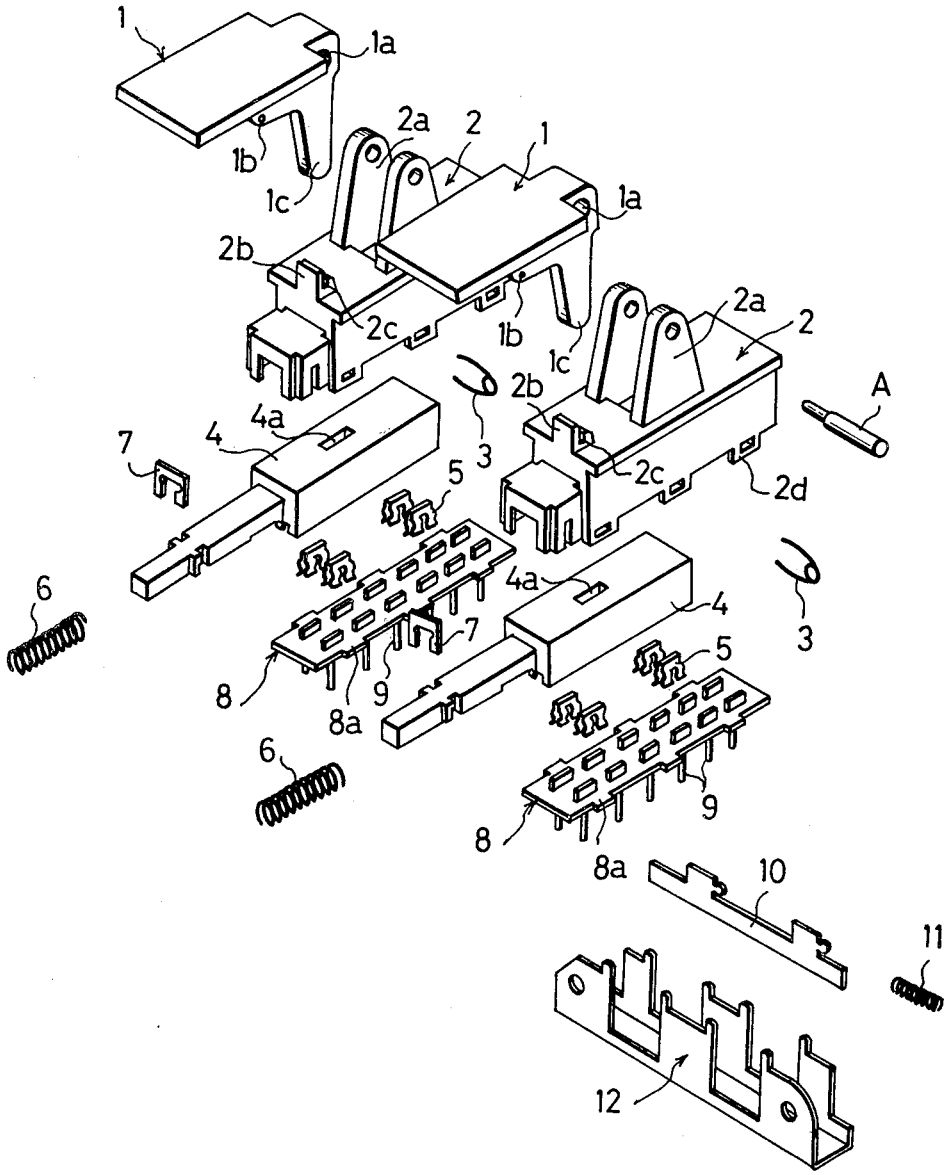

Referring to the drawings showing an embodiment of the present invention, a generally L-shaped driving lever 1 made from a synthetic plastic or similar material has a bore 1*a* for receiving a shaft, a retaining bore 1*b* in its mid portion for retaining one end of a reversing spring and a driving projection 1*c* for engagement with a recess in a sliding body.

A switch frame 2 formed from a synthetic plastic or similar material is provided at its upper surface with attaching arms 2*a* for supporting the driving lever 1, and a retaining portion 2*b* having a recessed groove 2*c*. The switch frame 2 is further provided at the lower portion of its side walls with a plurality of attaching legs 2*d* for attaching an insulating substrate plate to the frame 2.

A generally U-shaped reversing spring 3 made from a resilient metal has two generally parallel arm portions interconnected by an integral coil portion. One arm portion is inserted into the bore 1*b* of the driving lever and the other arm portion is retained by the groove 2*c* of the switch frame 2. A shaft A extends through the bores 1*a* and is adapted to support the driving lever 1 for free rotation.

A sliding body 4 also made of a synthetic plastic or similar material has a recess 4*a* which is engaged by the driving projection 1*c* of the driving lever 1 and a container section 4*b* in its body portion for containing a plurality of movable contacts 5.

A returning coiled spring 6 is adapted to be mounted on a projecting portion of the sliding body 4, while numeral 7 denotes a stopper plate.

The aforementioned insulating substrate plate 8 is provided with fixed contacts 9 arranged in parallel rows.

The insulating substrate plate 8 further has a plurality of projections 8*a* adapted to be retained by the attaching legs 2*d* to secure the plate 8 to the switch frame 2.

An interlocking cam plate 10 is adapted to operate a plurality of switches in an interlocked manner, and biased in one direction by means of a coiled spring 11.

An attaching bracket 12 consisting of a metallic plate is adapted to hold a plurality of switches.

Figure 2A:
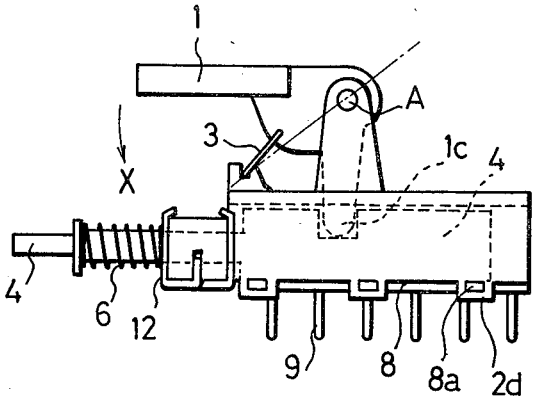
FIGS. 2A and 2B are illustrations explanatory of the manner of operation of a piano switch of FIG. 1.

In operation, as the driving lever 1 is depressed from the condition of FIG. 2A, it rotates around the shaft A in the direction of the arrow X, so that the retaining bore 1*b* moves in an arcuate path and the driving projection 1*c* causes a movement of the sliding body 4. Meanwhile, the reversing spring 3 is first compressed to the state of its maximum compression, and then comes to assume the state shown in FIG. 2B due to its own resiliency, during which the movable contacts 5 move to change the switch over.

Figure 2B:
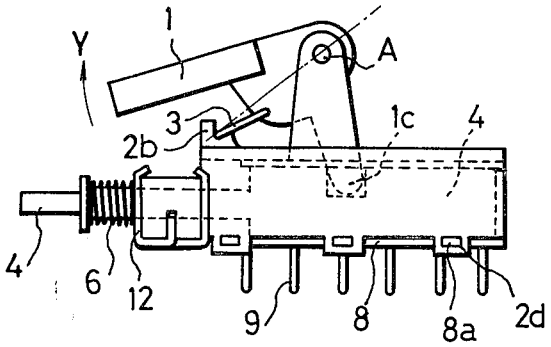

A rotation of the driving lever 1 from the state of FIG. 2B in the direction of arrow Y returns the switch to the state of FIG. 2A.

Consequently, an assisting force is imparted for the switching operation of the switch.

Although the switching is performed through rotating a driving lever 1 in the foregoing description, the operation section of the sliding body 4 may be actuated linearly by first a pushing action and then a pulling action.

As previously described, the piano switch incorporates a generally L-shaped driving lever and a generally U-shaped reversing spring extending between the retaining portion (i.e. the small bore) of the driving lever and the retaining portion (i.e. the recessed groove) of the switch frame, so that the switching operation of the switch is assisted by a suitable assisting force.

In addition, since the U-shaped reversing spring acts to bias the driving lever always onto the shaft, unfavourable clattering of the shaft is avoided to ensure a good feeling of operation.

What is claimed is:

1. A piano switch comprising:

a frame formed from an electrically insulating material and carrying a substrate plate having a plurality of fixed contacts thereon;

a sliding body held within said frame and having a projection portion extending outwardly from said frame, said sliding body being movable slidably between a first position and a second position spaced along said substrate plate and carrying a plurality of movable contacts adapted to engage selected ones of said fixed contacts in at least one of said first and second positions;

a driving lever supported pivotally at a midportion thereof to said frame, said driving lever being generally L-shaped and having an operating lever and a driving projection depending therefrom to engage said sliding body for moving it between said first and second positions during pivotal movement of said driving lever;

a first spring member having two generally parallel arm portions interconnected resiliently at end portions thereof, one of said arm portions being held to said driving lever adjacent said midportion thereof and the other of said arm portions being held to said frame whereby upon pivotal movement of said driving lever, said one arm portion will be moved in a generally arcuate path first towards said other arm portion and then away therefrom; and means including a second spring member operatively associated with said projecting portion of said sliding body for continually urging said sliding body into said first position, whereby said operation lever may be actuated to pivot said driving lever and slide said sliding body into said second position and said second spring member will thereafter serve to pivot said driving lever for returning said sliding body to its first position.

* * * * *